US006043182A

United States Patent [19]

Cordova et al.

[11] Patent Number: 6,043,182

[45] **Date of Patent: *Mar. 28, 2000**

[54] PRODUCTION OF OIL SOLUBLE CATALYTIC PRECURSORS

[75] Inventors: Jose Cordova, Caracas; Pedro Pereira, San Antonio de los Altos; Jose Guitian, Edo. Miranda; Antida Andriollo, Caracas; Alfredo Cirilo; Francisco Granadillo, both of Los Teques, all of Venezuela

[73] Assignee: Intevep, S.A., Caracas, Venezuela

[ * ] Notice: This patent is subject to a terminal disclaimer.

[21] Appl. No.: 09/071,340

[22] Filed: May 1, 1998

Related U.S. Application Data

[63] Continuation-in-part of application No. 08/838,834, Apr. 11, 1997, Pat. No. 5,885,441.

[51] Int. Cl.[7] ..... B01J 31/00; C10G 11/02

[52] U.S. Cl. ..... 502/107; 502/152; 502/151; 502/157; 502/184; 502/185; 208/14; 208/121; 208/124; 208/130

[58] Field of Search ..... 502/107, 151, 502/152, 157, 154, 184, 185; 208/251 R, 14, 19, 130, 121, 124

[56] References Cited

U.S. PATENT DOCUMENTS

| | | | |
|---|---|---|---|
| 3,676,331 | 7/1972 | Pitchford | 208/112 |
| 4,077,867 | 3/1978 | Aldridge et al. | 208/10 |
| 4,743,357 | 5/1988 | Patel et al. | 208/113 |
| 5,688,395 | 11/1997 | Carrazza et al. | 208/130 |
| 5,688,741 | 11/1997 | Carrazza et al. | 502/344 |
| 5,885,441 | 3/1999 | Pereira et al. | 208/130 |

*Primary Examiner*—Bekir L. Yildirim
*Attorney, Agent, or Firm*—Bachman & LaPointe, P.C.

[57] ABSTRACT

A method for preparing an oil soluble catalytic precursor includes the steps of: providing a mixture of a catalytic metal salt in water, wherein the catalytic metal salt contains a catalytic metal selected from the group consisting of alkali metals, alkaline earth metals, transition metals, and mixtures thereof; providing a heavy hydrocarbon phase; forming a water in oil emulsion of the mixture in the heavy hydrocarbon phase; and heating the emulsion at a temperature sufficient to dehydrate the emulsion so as to provide a hydrocarbon containing an oil soluble compound containing the catalytic metal.

19 Claims, 3 Drawing Sheets

PRODUCTION OF OIL SOLUBLE CATALYTIC PRECURSORS

CROSS-REFERENCE TO RELATED APPLICATIONS

This application is a continuation in part of application Ser. No. 838,834 filed Apr. 11, 1997, now U.S. Pat. No. 5,885,441.

BACKGROUND OF THE INVENTION

The invention relates to a method for preparing an oil soluble catalytic precursor and, more particularly, to a method for preparing a liquid hydrocarbon product containing precursors to catalytic metal which product is useful in processes such as hydroconversion, steam conversion, viscoreduction, coking, and the like.

Catalysts are well known for use in various processes for treating hydrocarbon feeds so as to provide upgraded or more valuable intermediate and final products. Although numerous disclosures have been made of various different types or forms of catalyst, the need remains for a simple and cost-effective method for providing intimate and substantially homogeneous mixture of a catalyst or catalytic metal with the hydrocarbon to be treated.

It is therefore the primary object of the present invention to provide a method for preparing a liquid hydrocarbon containing an oil soluble catalytic precursor.

It is a further object of the present invention to provide a method for preparing an oil soluble catalytic precursor wherein the starting materials are a relatively inexpensive and easily available salt, and a hydrocarbon which may be a portion of the feedstock.

Other objects and advantages of the present invention will appear hereinbelow.

SUMMARY OF THE INVENTION

In accordance with the present invention, the foregoing objects and advantages have been readily attained.

According to the present invention, a method is provided for preparing an oil soluble catalytic precursor, wherein the method comprises the steps of: providing a mixture of a catalytic metal salt in water, wherein said catalytic metal salt contains a catalytic metal selected from the group consisting of alkali metals, alkaline earth metals, transition metals, and mixtures thereof; providing a heavy hydrocarbon phase; forming a water in oil emulsion of said mixture in said heavy hydrocarbon phase; and heating said emulsion at a temperature sufficient to dehydrate said emulsion so as to provide a hydrocarbon containing an oil soluble compound containing said catalytic metal.

BRIEF DESCRIPTION OF THE DRAWINGS

A detailed description of preferred embodiments follows, with reference to the attached drawings, wherein.

DETAILED DESCRIPTION

Figure 1:
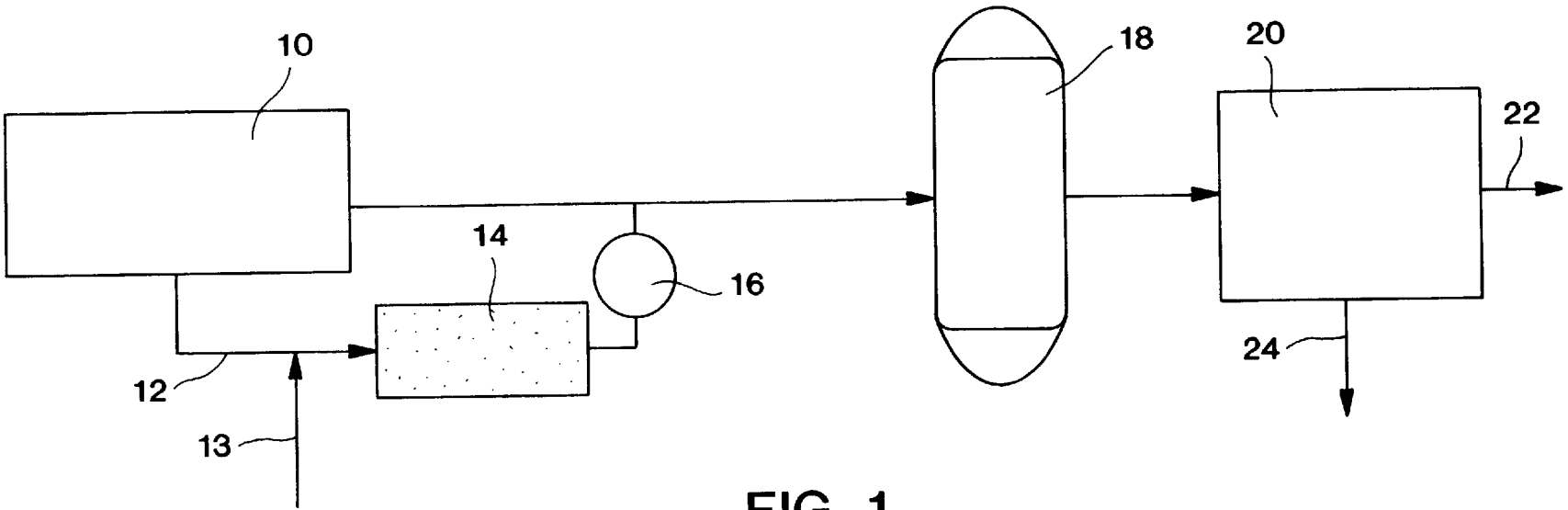
FIG. 1 schematically illustrates a method in accordance with the present invention.

The present invention relates to a method for preparing an oil soluble catalytic precursor and, particularly, to a method for preparing a liquid hydrocarbon containing an oil soluble precursor to a catalytic metal which is useful in enhancing a number of hydrocarbon upgrading processes such as, for example, hydroconversion, steam conversion, viscoreduction, coking and the like.

In accordance with the invention, a water-in-oil emulsion is formed wherein the dispersed water phase consists of a mixture of a salt of a catalytically active metal in water, and the continuous oil phase is a heavy hydrocarbon. This water-in-oil emulsion is formed using sufficient energy to provide a droplet size of the emulsion of less than or equal to about 1 micron. After emulsion formation, the emulsion is heated to a temperature sufficient to dehydrate the emulsion, leaving a hydrocarbon product containing the catalytic metal as desired, preferably in the form of an oil soluble metal salt. This process may be used to provide the final hydrocarbon containing catalytic metal as the actual feed to a reaction, or may be used to prepare a liquid additive to a separate feed, wherein the liquid additive includes the catalytically active metal. In accordance with the invention, the metal is preferably in the form of an oil soluble salt in the hydrocarbon which salt is a precursor to the actual catalyst which is formed by exposing the feedstock with additive to process conditions.

In accordance with the present invention, the hydrocarbon phase may suitably be a heavy crude, an extra heavy crude, a residue or the like, and may suitably be an atmospheric residue having an asphaltene content preferably greater than or equal to about 9% and having a resin content preferably greater than or equal to about 16%. Suitable examples of hydrocarbon for use in accordance with the present invention include Zuata short cut, long residue Zuata and the like.

According to the invention, and as set forth above, an aqueous mixture including a catalytic metal salt is used to form a water-in-oil emulsion with the above-described hydrocarbon. The mixture may be a dispersion or a solution depending upon the solubility of the metal salt. In most cases, this starting salt is oil insoluble.

In accordance with the present invention, the catalytic metal salt preferably contains a catalytic metal selected from the group consisting of alkali metals, alkaline earth metals, transition metals and mixtures thereof. More preferably, the catalytic metal salt includes catalytic metal selected from the group consisting of potassium, calcium, nickel, molybdenum and mixtures thereof. The actual catalytic metal salt is preferably selected from the group consisting of potassium hydroxide, calcium hydroxide, nickel acetate, molybdenum heptamolybdate and mixtures thereof. The aqueous mixture of catalytic metal salt may preferably be provided having a concentration of desired catalytic metal in water of at least about 1000 ppm.

As set forth above, a water-in-oil emulsion is preferably formed in accordance with the present invention from the mixture of catalytic metal salt in water and the hydrocarbon phase. This emulsion is preferably formed using sufficient mixing energy for a sufficient time so as to provide a final emulsion having an average droplet size of less than or equal to about 1 micron. Preferably, the emulsion is formed at a temperature of between about 90° C. and 300° C., most preferably at a temperature of about 100° C., and at a mixing rate of between about 600 rpm and about 1200 rpm to which the emulsion is exposed for at least about 5 minutes. The hydrocarbon phase and mixture of catalytic metal salt in water are each preferably provided at a temperature of between about 50° C. and about 100° C. The phases can be heated, if necessary to reach a desired emulsion formation temperature.

After the emulsion is formed, the emulsion is preferably heated at a temperature sufficient to dehydrate the emulsion so as to provide a remaining hydrocarbon phase which contains the catalytic metal. In accordance with the present invention, this heating step is believed to induce interfacial reaction between heavy heteroatomic components or polar molecules of the crude or heavy hydrocarbon, and salt cations/anions in the water phase so as to form a chemical association between the catalytic metal and hydrocarbon as desired. The reaction product of this step is an oil soluble compound which advantageously serves as a catalyst precursor, and is believed to be an oil soluble salt of the desired catalyst metal and certain components of the hydrocarbon such as naphthenate, oleate and the like. This heating step may preferably be carried out at a temperature of at least about 200° C., at atmospheric or ambient pressure, and for a time of at least about 1 hour. This heating step is preferably carried out so as to substantially completely dehydrate the hydrocarbon phase, preferably leaving a maximum water content of less than or equal to about 1%.

The resulting hydrocarbon containing catalytic metal precursor can be used itself as a process feedstock for upgrading the hydrocarbon, or may be added as a liquid additive to a feedstock to be treated. In one preferred embodiment of the present invention, the hydrocarbon phase from which the water-in-oil emulsion is formed may be separated off from a feedstock stream to be treated, and re-introduced to the stream prior to entry into a process reactor and the like, and after incorporation of the catalytic metal precursor in accordance with the present invention.

As set forth above, the catalytic metal which is incorporated into the liquid hydrocarbon additive of the present invention is preferably a metal which is suitable for catalyzing a desired reaction or process, preferably a hydroconversion, steam conversion, viscoreduction, coking or other desirable reaction. Of course, the teachings of the present invention could readily be adapted to preparing a catalytic metal precursor containing metals which are useful for enhancing other reactions as well.

It has been found in accordance with the present invention that emulsion formation as discussed above, followed by heating, serves to provide a very high level of active metal precursor contained within the final liquid hydrocarbon product. This catalytically active metal precursor is, advantageously, now in oil soluble form and contained in a liquid hydrocarbon phase which can readily be mixed with other hydrocarbon feeds as desired. In accordance with the present invention, the final hydrocarbon feed, either prepared directly from the heated emulsion, or as a result of a mixture of the heated emulsion product and a separate feedstock stream, preferably contains catalytic metal in an amount of at least about 100 ppm.

Referring now to FIG. 1, an example of one embodiment of a method of the present invention is schematically illustrated. A feed 10 may suitably be provided of the desired heavy oil feed to be treated. A portion 12 of feed 10 may suitably be separated from main feed 10, and mixed with a solution or dispersion 13 of the desired catalytic metal salt. This mixture is then passed to a static mixer 14 wherein sufficient mixing energy is provided so as to form a water-in-oil emulsion of the aqueous phase, containing catalytic metal salt, in the heavy hydrocarbon. The resulting emulsion is then fed to a preheater 16 for heating to a desired dehydrating temperature, preferably at least about 200° C. so as to dehydrate the emulsion and induce interfacial reactions between the catalytic metal salt and elements of the hydrocarbon as desired.

Still referring to FIG. 1, the resulting dehydrated hydrocarbon liquid, containing the desired catalytic metal salt in oil soluble form, is then re-introduced into the stream of feed 10, and fed to a reactor 18 for the desired upgrading process. The resulting product 20 from reactor 18 preferably includes an upgraded hydrocarbon phase 22 and a fraction 24 containing the catalytic metal from the initial hydrocarbon liquid additive. In accordance with the invention, the remaining fraction 24 containing catalytic active metal may suitably be treated or recycled in accordance with the present invention so as to provide catalytic metal for use in forming the mixture 13 (solution or dispersion) of catalytic metal salt in water as desired in accordance with the present invention.

Of course, it should be noted that FIG. 1 is merely a schematic representation of one embodiment of the method of the present invention, and the method could of course be carried out using variations of these steps and different equipment and the like.

In further accordance with the invention, it has been found that a number of factors affect the maximum concentration of catalytic metal which can be incorporated into the final hydrocarbon product. For example, it has been found that the temperature at which the emulsion is formed has a direct result on maximum concentration. The range of 90° C. to 300° C. is a range of effective temperatures for emulsion formation, but the most preferred temperature is a temperature of approximately 100° C. It has also been found that the degree of oxidation of the catalytic metal affects the amount of concentration which can be reached in the final hydrocarbon product. In this regard, it has been found that the larger the degree of oxidation of the metal, the less such metal can be incorporated into the hydrocarbon as desired.

Still further, it has been found that a higher level of asphaltene in the beginning crude results in a greater possible concentration of incorporated catalytic metal, and that a feed containing a greater amount of resin also provides for incorporation of a greater concentration or amount of catalytically active metal.

The following examples further illustrate the preparation of hydrocarbon fractions containing precursors of catalytic active metal according to the present invention.

EXAMPLE 1

Figure 2:
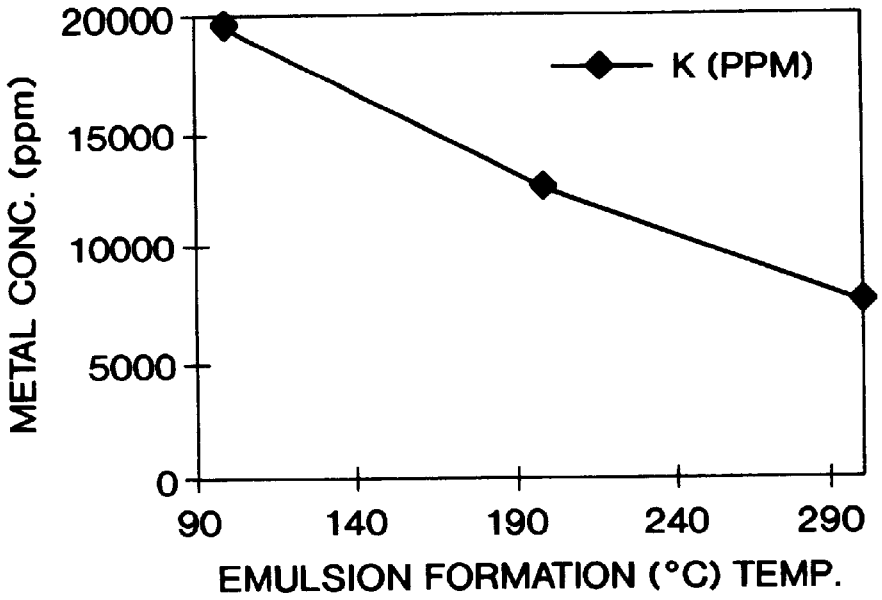
FIG. 2 illustrates the relation between maximum metal concentration and the temperature at which the emulsion was formed in accordance with the present invention for potassium.
Figure 3:
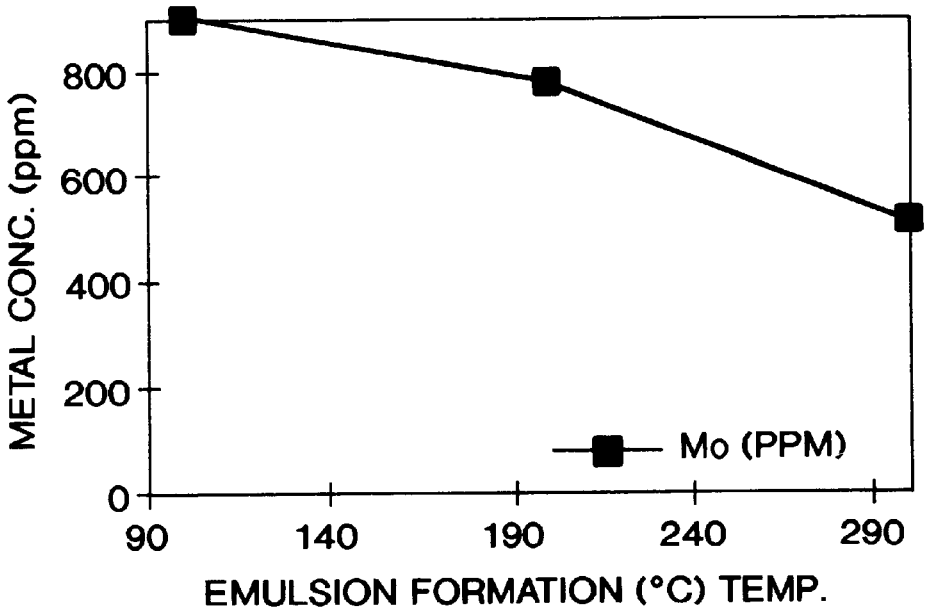
FIG. 3 illustrates the relation between maximum metal concentration and emulsion formation temperature for molybdenum.

In this example, a long residue Zuata crude was provided as a hydrocarbon phase, and the mixture containing catalytic metal was provided including a solution of potassium hydroxide in one case, and a solution of calcium hydroxide in the other. Emulsions were formed of each of these mixtures at an emulsion formation temperature of about 200° C., and the resulting emulsion was then subjected to an activation temperature of 200° C. for about 30 minutes. The resulting product was substantially dehydrated, and at the given temperatures, a maximum of 12,600 ppm of potassium and 3,250 ppm of calcium could be incorporated into the hydrocarbon. These values were also gathered for the same ingredients wherein the emulsion was formed at 100° C., and also wherein the emulsion was formed at 300° C., and also for emulsions prepared with molybdenum. The resulting maximum concentrations are illustrated in FIGS. 2 and 3 for potassium and molybdenum, respectively. As shown in each case, the higher the emulsion formation temperature, the lower the level of maximum obtainable active metal concentration.

EXAMPLE 2

In this example, the method of the present invention was followed using long residue Zuata crude as the hydrocarbon phase, and using aqueous mixtures including potassium hydroxide and nickel acetate. In this example, the emulsion was formed as set forth above, with mixing at 1200 rpm for 15 minutes, wherein the emulsion was prepared at a temperature of approximately 100° C., and subsequent heating or activation was carried out at a temperature of 200° C. and for a period of 30 minutes. Under these circumstances, a maximum concentration of potassium in the final product was obtained at about 19,600 ppm, and a maximum concentration of nickel was obtained in an amount of about 5,800 ppm.

EXAMPLE 3

Figure 4:
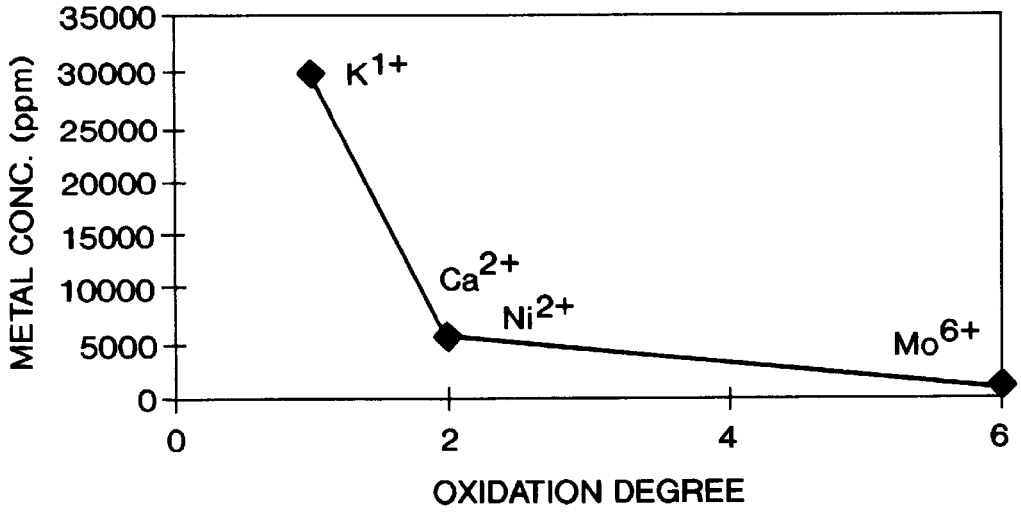
FIG. 4 illustrates the relation between maximum metal concentration and the degree of oxidation of the metal.

In this example, a number of different hydrocarbon products were prepared using aqueous mixtures of catalytic metal based on potassium, calcium, nickel and molybdenum. For each of these samples, the metals were provided having different degrees of metal oxidation. FIG. 4 attached hereto sets forth the results of these examples in terms of the maximum level of metal which could be incorporated into the feed for each type of catalytic active metal. As shown in FIG. 4, the maximum metal concentration decreases as the oxidation degree increases.

EXAMPLE 4

This example demonstrates that when the feedstock contains a greater amount of asphaltenes, transition metals as catalytic metals are more readily incorporated into the final hydrocarbon product. In this example, final hydrocarbons were prepared using nickel and molybdenum in connection with a heavy hydrocarbon phase (LRZ) containing 19.6% asphaltenes, and a feed (LRB) containing 9.1% asphaltenes. The feeds are characterized in Table 1.

TABLE 1

| Characteristic | Long residue Zuata | Long residue Bachaquero |
|---|---|---|
| API(60° F.) | 7.5 | 7.1 |
| Micro Carbon Conradson (%) | 14.8 | 14.7 |
| Total acidity number (mg KOH/g) | 3.0 | 2.8 |
| SARA Distribution (TLC), % wt. | 11.4 | 14.7 |
| Saturated | | |
| Aromatic | 52.4 | 55.9 |
| Resin | 16.6 | 20.3 |
| Asphaltene | 19.6 | 9.1 |
| C (% P) | 84.3 | 84.7 |
| H (% P) | 10.7 | 10.1 |
| O (% P) | 1.8 | 1.8 |
| S (% P) | 3.4 | 3.2 |
| N (% P) | 0.63 | 0.59 |

Table 2 below sets forth the maximum amount of metal which could be added for each of these hydrocarbons.

TABLE 2

| | Maximum quantity of added metal (ppm) in the LRZ (asphaltenes = 19. 6%) | Maximum quantity of added metal (ppm) in the LRB (asphaltenes = 9.1%) |
|---|---|---|
| Ni | 5800 | 2604 |
| Mo | 900 | 690 |

As shown, the feed having a 19.6% asphaltene level allowed for significantly greater contents of nickel and molybdenum as compared to the example run using a feed having only 9.1% asphaltenes.

This example also demonstrates that when the feedstock is more resinous; larger quantities of alkali and less alkaline earth metals can be incorporated. In this regard, final hydrocarbons were prepared from emulsions which were formed of hydrocarbon phases, one having a resin content of about 20.3%, and the other having a resin content of about 16.6%. Emulsions were formed according to the method of the present invention using mixtures of potassium hydroxide and calcium hydroxide, followed by emulsion formation and heating in accordance with the present invention. Table 3 set forth below presents the results of this example.

TABLE 3

| | Maximum quantity of metal added (ppm) (resins = 16.6%) | Maximum quantity of metal added (ppm) (resins = 20.3%) |
|---|---|---|
| K | 19,600 | 30,000 |
| Ca | 3,250 | 2,604 |

As shown, a larger resin content led to a larger possible maximum alkali metal content and reduced maximum alkaline earth metal content.

EXAMPLE 5

Figure 5:
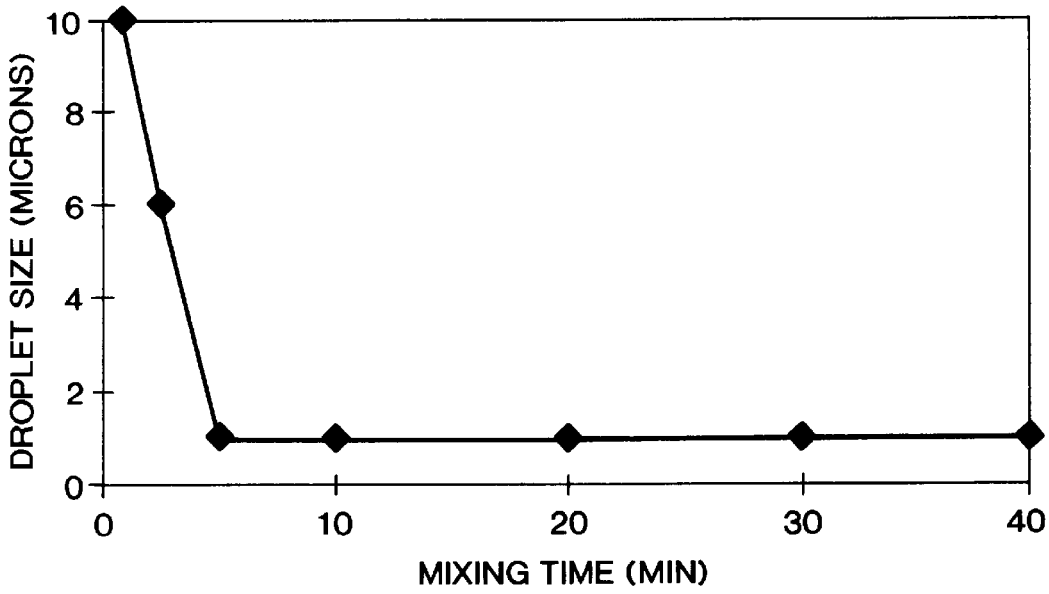
FIG. 5 illustrates the relation between droplet size of an intermediate emulsion prepared in accordance with the invention as compared to mixing time.

This example illustrates the time required to provide an emulsion as desired having a suitable droplet size of less than or equal to about 1 micron. In this example, an emulsion is formed from LRB hydrocarbon and using KOH as a catalytic metal additive, and at a mixing rate between about 600 rpm and about 1200 rpm which was carried out for different periods of time as illustrated in FIG. 5. Referring to FIG. 5, it is clear that at least five minutes of this mixing rate is desirable so as to provide suitably sized droplets of less than or equal to about 1 micron.

EXAMPLE 6

This example illustrates the relative solubility in oil of various catalytic metal precursor salts wherein the emulsion was formed at different temperatures.

In this example, two different heavy hydrocarbon phases were provided for evaluation. One hydrocarbon phase is Zuata crude residue, while the other hydrocarbon phase is Bachaquero crude residue. In this test, emulsions were formed for each type of hydrocarbon at 100, 200 and 300° C., and for each of potassium, calcium, nickel and molybdenum in the forms of potassium hydroxide, calcium hydroxide, nickel acetate and molybdenum heptamolybdate. Referring to Table 4 below, the results obtained in terms of maximum metal concentration are presented. As shown, the alkali metal (potassium) is most soluble, and the transition metal (molybdenum) is least soluble. Further, it is again noted that at least for potassium larger maximum concentrations were obtained when the emulsion was prepared at lower temperatures, with best results obtained at an emulsion formation temperature of about 100° C.

TABLE 4

EMULSION TEMPERATURE EFFECT ON THE OIL SOLUBILITY OF THE METALS

| | OIL SOLUBLE METAL CONCENTRATION (PPM) CRUDE RESIDUE | | | | | |
|---|---|---|---|---|---|---|
| | ZUATA EMULSION TEMP. (° C.) | | | BACHAQUERO EMULSION TEMP. (° C.) | | |
| | 100 | 200 | 300 | 100 | 200 | 300 |
| K | 19,600 | 12,600 | 7,600 | 30,000 | 26,200 | 7,600 |
| Ca | 2,600 | 3,250 | 2,800 | 1,860 | 5,400 | 1,500 |
| Ni | 5,800 | 4,400 | 3,600 | 2,604 | 1,400 | 2,072 |
| Mo | 900 | 780 | 520 | 690 | 120 | 200 |

In accordance with the foregoing, it should readily be appreciated that a method has been provided for preparing an oil soluble catalytic precursor which can readily be incorporated into various desired hydrocarbon feedstocks for use in generating desired catalyst for or during reactions such as hydroconversion, steam conversion, viscoreduction, coking and the like. The oil soluble catalytic precursor is advantageously prepared using inexpensive and readily available ingredients, and can be used so as to provide a relatively large concentration of metal if desired, depending upon the eventual upgrading process to be used.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

We claim:

1. A method for preparing an oil soluble catalytic precursor, comprising the steps of:

providing a mixture of a catalytic metal salt in water, wherein said catalytic metal salt contains a catalytic metal selected from the group consisting of alkali metals, alkaline earth metals, transition metals, and mixtures thereof;

providing a heavy hydrocarbon phase;

forming a water in oil emulsion of said mixture in said heavy hydrocarbon phase; and heating said emulsion at a temperature sufficient to dehydrate said emulsion so as to provide a hydrocarbon containing an oil soluble compound containing said catalytic metal.

2. A method according to claim 1, wherein said heating step comprises heating said emulsion to a temperature of at least about 200° C. whereby interfacial reactions occur between said catalytic metal salt and said heavy hydrocarbon phase so as to provide said oil soluble compound containing said catalytic metal.

3. A method according to claim 1, wherein said mixture is provided at a temperature of between about 50° C. and about 100° C., and wherein said heavy hydrocarbon phase is provided at a temperature of between about 50° C. and about 100° C.

4. A method according to claim 1, wherein said step of forming said emulsion is carried out at a temperature of between about 90° C. and about 300° C.

5. A method according to claim 4, wherein said step of forming said emulsion is carried out at a temperature of about 100° C.

6. A method according to claim 1, wherein said step of forming said emulsion is carried out at a mixing rate and time sufficient to provide said emulsion having a droplet size less than or equal to about 1 micron.

7. A method according to claim 6, wherein said step of forming said emulsion is carried out at between about 600 rpm and about 1200 rpm for a period of at least about 5 minutes.

8. A method according to claim 1, wherein said step of providing said heavy hydrocarbon phase comprises providing an atmospheric residue containing asphaltenes in an amount of at least about 9% (wt.) based on said atmospheric residue.

9. A method according to claim 1, wherein said step of providing said heavy hydrocarbon phase comprises providing an atmospheric residue containing resin in an amount of at least about 16% (wt.) based on said atmospheric residue.

10. A method according to claim 1, wherein said step of providing said mixture comprises providing said catalytic metal salt in water in a form selected from the group consisting of solutions, dispersions and combinations thereof.

11. A method according to claim 1, wherein said step of providing said mixture comprises providing said catalytic metal selected from the group consisting of potassium, calcium, nickel, molybdenum and mixtures thereof.

12. A method according to claim 1, wherein said step of providing said mixture comprises providing said catalytic metal salt selected from the group consisting of potassium hydroxide, calcium hydroxide, nickel acetate, molybdenum heptamolybdate and mixtures thereof.

13. A method according to claim 1, further comprising the step of treating said hydrocarbon containing said catalytic metal in a process which is enhanced by said catalytic metal so as to obtain an upgraded hydrocarbon product.

14. A method according to claim 1, wherein said forming step comprises forming said emulsion from said mixture and said hydrocarbon phase in amounts sufficient to provide said hydrocarbon containing said catalytic metal at a concentration of at least about 100 ppm (wt.).

15. A method according to claim 1, further comprising the step of providing a process hydrocarbon feedstock, mixing said hydrocarbon containing said catalytic metal with said hydrocarbon feedstock so as to provide a reaction feedstock having a concentration of said catalytic metal of at least about 100 ppm (wt.), and treating said reaction feedstock in a process which is enhanced by said catalytic metal so as to provide process products including an upgraded hydrocarbon product.

16. A method according to claim 15, wherein said process is selected from the group consisting of hydroconversion, viscoreduction, steam conversion, coking and combinations thereof.

17. A method according to claim 15, wherein said process products further include a fraction containing said catalytic metal, and further including the step of recycling said fraction containing said catalytic metal so as to provide said catalytic metal salt for said mixture.

18. A method according to claim 1, wherein said heating step provides said hydrocarbon having said catalytic metal substantially homogeneously dispersed therein.

19. A hydrocarbon containing a catalytic metal precursor in the form of an oil soluble compound containing a metal selected from the group consisting of alkali metals, alkaline earth metals, transition metals and mixture thereof, wherein said hydrocarbon contains said metal at a concentration of at least about 100 ppm (wt.).

* * * * *